US005698939A

United States Patent [19]

Vriens et al.

[11] Patent Number: 5,698,939

[45] Date of Patent: Dec. 16, 1997

[54] DISPLAY DEVICE HAVING A DISPLAY WINDOW

[75] Inventors: Leendert Vriens; Johannes C. A. Van Nes; Frank Gersmann, all of Eindhoven, Netherlands

[73] Assignee: U.S. Philips Corporation, New York, N.Y.

[21] Appl. No.: 40,956

[22] Filed: Mar. 31, 1993

[30] Foreign Application Priority Data

Apr. 6, 1992 [EP] European Pat. Off. ..... 92200970

[51] Int. Cl.[6] ..... H01J 29/86

[52] U.S. Cl. ..... 313/477 R; 220/2.1 R; 220/2.3 A

[58] Field of Search ..... 313/477 R; 220/2.1 R, 220/2.3 A, 2.1 A

[56] References Cited

U.S. PATENT DOCUMENTS

| | | | |
|---|---|---|---|
| 4,570,101 | 2/1986 | Campbell | 313/461 |
| 4,839,556 | 6/1989 | Ragland, Jr. | 313/408 |
| 4,881,004 | 11/1989 | Inoue et al. | 313/408 |
| 4,887,001 | 12/1989 | D'Amato et al. | 123/519 |
| 4,924,140 | 5/1990 | Hirai et al. | 313/477 R |
| 4,985,658 | 1/1991 | Canevazzi | 313/477 R |
| 5,155,410 | 10/1992 | Wakasond et al. | 313/402 |
| 5,274,303 | 12/1993 | Bakker et al. | 313/477 R |

*Primary Examiner*—Nimeshkumar Patel
*Attorney, Agent, or Firm*—John C. Fox

[57] ABSTRACT

A display device having a cathode ray tube which comprises a display window. The radius of curvature of the inside of the display window along the diagonal ($R_{diag}$) is greater than 1.6×1.767×D and smaller than 3.0×1.767×D, where D is the length of the diagonal of the display window. For the inside surface it holds that the quotient of the sagittal height at the end of the diagonal (21) and the sum of the sagittal heights at the end of the long axis (22) and at the end of the short axis (23) ranges between 0.75 and 0.95. In embodiments, the inside surface also complies with the formula $1.5<R_x(0,0)/R_x(x_{max}, O)<4$, where $R_x(0,0)$ and $R_x(x_{max}, 0)$ are the radii of curvature along the long axis in the centre of the display window and at the end of the long axis, respectively. By virtue thereof, an improved picture display as regards reflection, local doming and raster distortion can be obtained.

12 Claims, 2 Drawing Sheets

DISPLAY DEVICE HAVING A DISPLAY WINDOW

BACKGROUND OF THE INVENTION

The invention relates to a display device having a cathode ray tube which comprises an evacuated envelope having an at least substantially rectangular display window an inside area of which is provided with a phosphor screen, a colour selection electrode being arranged in front of the display window, the envelope accommodating a means for generating at least one electron beam and the display device comprising means for deflecting the electron beam(s) across the phosphor screen.

Display devices of the type mentioned in the opening paragraph are known.

Such display devices are used, inter alia, in television receivers and computer monitors.

The invention also relates to a cathode ray tube for use in a display device of the type described in the opening paragraph.

The invention further relates to a display window for use in a display device of the type described in the opening paragraph.

Known cathode ray tubes comprise an evacuated envelope having a display window an inside area of which is provided with a phosphor screen. A colour selection electrode is arranged in front of the phosphor screen. The envelope comprises a means for generating at least one electron beam. The electron beam(s) excite(s) phosphors in the phosphor screen. In operation, the electron beams are deflected across the phosphor screen, thereby generating images. When a viewer watches a cathode ray tube, he will see these images after they have been transmitted through the glass of the display window. The viewer can also see ambient light which is reflected at the outside surface and the inside surface of the display window and at the phosphor layer. For the last few years the trend has been to manufacture flatter display windows. There is also a trend towards reduction of the curvature along the side faces of the display window. The quality of the image produced, as will be explained within the framework of the invention, is governed in a complex manner by the shape of the display window.

In this connection, four aspects can be distinguished.

- Curved side faces of the display window are experienced as a reduction of picture quality.
- Distortions in the reflection image of, for example, straight lines such as a window or a fluorescent tube, are experienced as a reduction of picture quality.
- Raster distortion reduces picture quality.
- Local doming reduces picture quality.

Raster distortion is to be understood to mean herein a picture error which causes straight lines to be reproduced as curved lines. Local doming is to be understood to mean herein a picture error which can be attributed to the fact that, in operation, the colour selection electrode warms-up and expands, causing the colour selection electrode to be displaced relative to the phosphor screen.

OBJECTS AND SUMMARY OF THE INVENTION

It is an object of the invention to provide a display device of the type set forth in the opening paragraph, which display device comprises a relatively flat display window having an improved picture quality in at least one of the above-mentioned aspects.

To this end, the display device and the cathode ray tube suitable for the display device according to the invention are characterized in that the outside surface of the display window has an average radius of curvature along the diagonal ($R_{diag}$) above 2.83×D and below 5.3×D, where D is the length of the diagonal of the display window, and the inside surface of the display window has a relative sagittal height (RSH) which ranges between 0.75 and 0.95, the relative sagittal height being the quotient of the sagittal height at the end of the diagonal across the inside surface and the sum of the sagittal heights at the end of the long axis and at the end of the short axis, also across the inside surface.

The invention is based on the following recognitions:

- Curved side faces of the display window are experienced as a reduction of picture quality.
- Straight side faces of a display window lead to a colour selection electrode which is too flat near the side faces and leads to excessive local doming.
- Too much variation of the radii of curvature along the display window leads to an unpleasant distortion of reflected light sources.
- The shape of the display window influences the mechanical strength of the display window, parts which are locally too flat should be avoided.
- The shape of the display window influences the raster distortions. In this connection, particularly the north-south distortion of the image written by the electron beams, which is difficult to correct electronically, is important.
- The shape of the colour selection electrode follows the shape of the inside of the screen.

Consequently, the shape of the display window also influences

- the local doming of the colour selection electrode and
- the strength of the colour selection electrode.

All in all, it can be concluded that the shape of the display window is very important. The importance of the shape increases as the flatness of the display windows increases. A flat display window has a relatively large radius of curvature $R_{diag}$. The display device according to the invention comprises a cathode ray tube having a relatively flat display window. A number of the above points lead to contradictory requirements, as will be explained hereinbelow. In addition to the average radius of curvature along the diagonal, display devices according to the invention and cathode ray tubes suitable for display devices according to the invention are also characterized by the relative sagittal height in the corner (RSH). The relative sagittal height is defined as the sagittal height in the corner of the display window ($z_{max}$) divided by the sum of the sagittal heights at the end of the long axis and at the end of the short axis ($z(x_{max},0)+z(0,y_{max})$):

$$RSH=z_{max}/(z(x_{max},0)+z(0,y_{max})$$

The sagittal height z is the z-coordinate of a point, i.e. the distance between the tangent plane to the centre of the display window and the relevant point viewed in the z-direction, which direction extends perpendicularly to said plane and to the customary x- and y-directions.

A relatively small value of RSH (smaller than or equal to 0.75) results in relatively straight side faces of the display window but has the disadvantage that negative radii of curvature may occur in the vicinity of the corners of the image. Negative radii of curvature have a negative influence on the local doming and strength of the colour selection electrode. Negative radii of curvature can be precluded, however, this leads to large variations in the radii of curvature along the display window. This leads to a reflection image which looks like a distorting mirror and, hence, adversely affects picture quality. Also this effect can be precluded to a certain degree. However, analysis shows that this would lead to an unacceptable increase in raster distortion. Constructions in which RSH=0.70 or less yield display windows having straight side faces. However, the variation in the radius of curvature along the surface is substantial, causing much distortion of reflected images. In addition, local doming near the end of the long axis is substantial and such constructions exhibit a high degree of raster distortion.

Relatively great values of RSH, for example above or equal to 0.95, generally exhibit a visually attractive, small variation of the radii of curvature along the surface. However, a disadvantage of such a construction is that the side faces of the display window are curved considerably. An additional disadvantage of a construction having a large RSH and relatively considerably curved side faces is that this leads to a substantial degree of local doming and to an increase of the pincushion-shaped distortion of the image for values of x in the range from 0 to approximately 0.7.

The value of RSH preferably ranges between 0.80 and 0.90. As RSH decreases from 0.80 to 0.75, the straightness of the side faces of the display window increases, but the variation of the radii of curvature along the surface increases too. For RSH<0.75, this variation is so large that the reflection image at the display window looks like a distorting mirror. For values above 0.80 this effect is no longer disturbing. A reduction of RSH from 0.80 to 0.75 also leads to a reduction in strength of the glass and the colour selection electrode along the long and/or short axis. As RSH increases from 0.90 to 0.95, the curvature of the side faces of the display window increases. Due to this there is less space for reducing local doming.

In an embodiment of the display device according to the invention, the inside surface complies with the formula $1.5<R_x(0,0)/R_x(X_{max},0)<4$, where $R_x(0,0)$ and $R_x(X_{max},0)$ are the radii of curvature along the long axis in the centre of the display window and at the end of the long axis, respectively.

The display device can be further improved if $R_x$ decreases along the long axis in the direction from the centre to the edge (in this case the curvature of the surface increases). Preferably, $R_x(0,0)/R_x(x_{max},0)$ lies in the range between 1.5 and 4.0. $R_x$ is too small at the end of the long axis for values above 4.0, which would lead to visually excessive distortion of the reflection. Values of $R_x(0,0)/R_x(x_{max},0)$ below 1.5 result in an increase of local doming. Preferably, $R_x(0,0)/R_x(x_{max},0)$ ranges between 2.0 and 3.2.

The choice of RSH and the variation of $R_x$ along the long axis substantially fixes the sagittal height at the end of the short axis.

An embodiment of the display device according to the invention is characterized in that $R_y(0,0)/R_y(0,y_{max})$ ranges between 0.9 and 1.5 for the inside surface of the display window, where $R_y(0,0)$ is the radius of curvature along the short axis in the centre of the display window and $R_y(0,y_{max})$ is the radius of curvature along the short axis at the end of the short axis.

Aspects relating to strength and an analysis of the raster distortion have given an insight into the desired variation of $R_y$ along the short axis. A display device which is further improved as regards strength and raster distortion can be obtained if $R_y(0,0)/R_y(0,y_{max})$ ranges between 0.9 and 1.5.

These and other aspects as well as further embodiments and advantages of these embodiments will be described in the description of the Figures.

BRIEF DESCRIPTION OF THE DRAWING

The invention will be explained in greater detail by means of a few exemplary embodiments of the cathode ray tube according to the invention and with reference to the accompanying drawings, in which.

The Figures are not drawn to scale. In the Figures, corresponding parts generally bear the same reference numerals.

DESCRIPTION OF THE PREFERRED EMBODIMENTS

Figure 1:
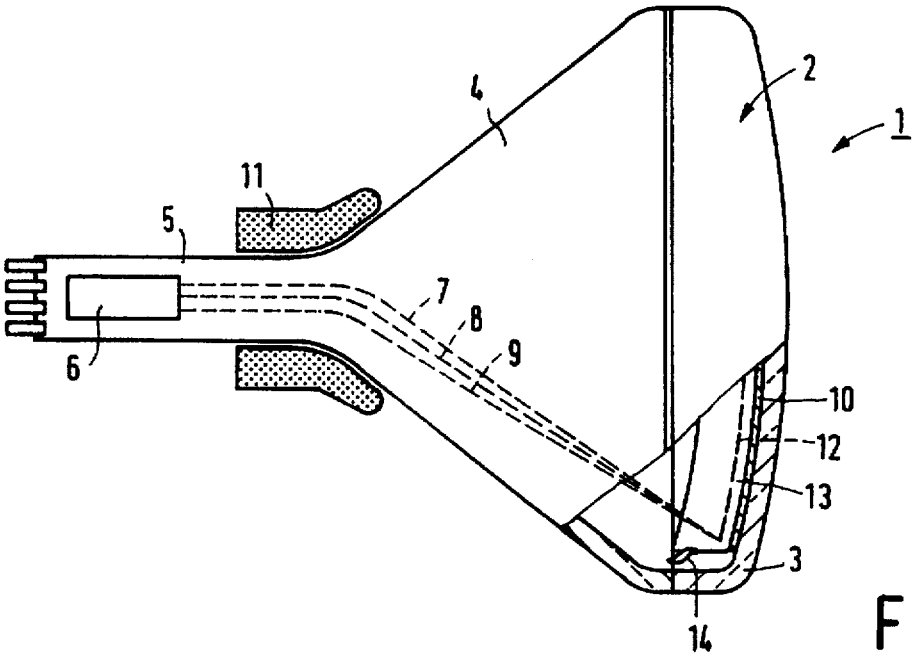
FIG. 1 is a sectional view of a cathode ray tube.

A cathode ray tube, in this example colour display tube 1, comprises an evacuated envelope 2 which consists of a display window 3, a cone portion 4 and a neck 5. In the neck 5 there is provided an electron gun 6 for generating three electron beams 7, 8 and 9 which extend in one plane, the in-line plane, in this case the plane of the drawing. A display screen 10 is situated on the inside of the display window. Said display screen 10 comprises a large number of phosphor elements luminescing in red, green and blue. On their way to the display screen 10, the electron beams 7, 8 and 9 are deflected across the display screen 10 by means of deflection unit 11 and pass through a colour selection electrode 12 which is arranged in front of the display window 3 and which comprises a thin plate having apertures 13. The colour selection electrode is suspended in the display window by means of suspension means 14. The three electron beams 7, 8 and 9 pass through the apertures 13 of the colour selection electrode at a small angle and, consequently, each electron beam impinges on phosphor elements of only one colour.

Figure 2:
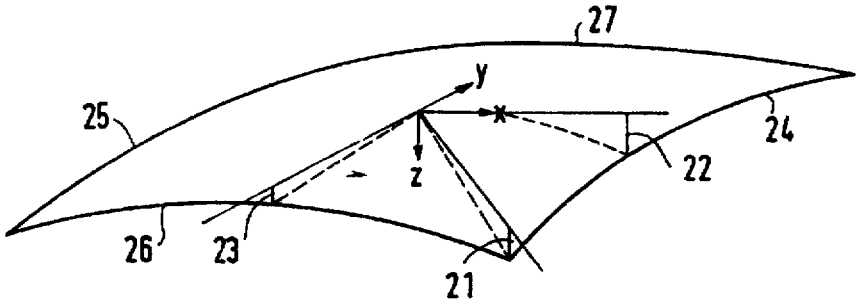
FIG. 2 is a partly perspective view of a display window.

FIG. 2 is a partly perspective view of a surface of a display window. The points of the surface can be described by a function z=f(x,y), where z is the distance between a point and the tangent plane to the centre of the surface, and x and y are the customary denominating letters for the coordinates of a point on the surface. z Is commonly termed the sagittal height. $y_{max}$ Is the y-coordinate of a point at the end of the short axis, and of points having an equal y-coordinate. $x_{max}$ Is the x-coordinate of a point at the end of the long axis, and of points having an equal x-coordinate. The z-axis extends perpendicularly to the tangent plane in the centre of the surface of the display window and is indicated in the Figure. The short axis is referred to as the y-axis, the long axis is referred to as the x-axis. Said axes extend perpendicularly to each other and to the z-axis. Both the inside surface and the outside surface can be described in such a manner. In FIG. 2, the sagittal height $z_{max}$ in the corners is indicated by line segment 21 and the sagittal height at the end of the long axis $z_{max}(x_{max},0)$ and the sagittal height at the end of the short axis $z_{max}(0,y_{max})$ by line segments 22 and 23, respectively. The ends of the short and long axes are given by the extreme points of the above-described raster in the x-direction and y-direction, respectively.

Such a surface z(x,y) can be characterized to a considerable degree by means of:

1. The average radius of curvature along the diagonal $R_{diag}$
2. The relative sagittal height in the corner, RSH.
3. The variation of the radius of curvature $R_x$ along the long axis, i.e. the X-axis.
4. The variation of the radius of curvature $R_y$ along the short axis, i.e. the Y-axis.

Known display devices generally have relatively considerably curved surfaces. The average radius of curvature of the outside surface along the diagonal, i.e. the average radius of curvature from the centre to the corner of the raster described is equal to, for example, $R_{diag} \cong 2.3 \times D$, where D is the length of the diagonal. The average radius of curvature along the diagonal can be calculated from the sagittal height at the end of the diagonal ($z_{max}$):

$$(R_{diag}-z_{max})^2+D^2/4=R^2_{diag}.$$

Flatter constructions result in a larger average radius of curvature along the diagonal and hence, in a proportionally reduced sagittal height in the corners, $z_{max}=z(x_{max},y_{max})$. The present invention relates to a relatively flat display window, i.e. a display window having a relatively large radius of curvature along the diagonal. A display device according to the invention has a radius of curvature along the diagonal $R_{diag}$ which is greater than $1.6 \times 1.767 \times D$ and smaller than $3.0 \times 1.767 \times D$, for example in the range between $1.75 \times 1.767 \times D$ and $2.25 \times 1.767 \times D$.

Within the framework of the invention, the relative sagittal height RSH is defined by:

$$RSH=z_{max}/(z(x_{max},0)+z(0,y_{max})).$$

In the known, more curved, display windows RSH was substantially equal to 1.0, both for the inside surface and the outside surface. This is also true for cylindrical display windows having substantially straight side faces. A reduction of RSH results in a reduced curvature of the side faces of the display window, indicated in FIG. 2 by curved line segments 24, 25, 26 and 27. Said side faces are also referred to as the "bezels" of the display window. RSH can, in principle, range between 1.0 (the known constructions having considerably curved side faces) and 0.5 (completely straight side faces on all sides).

Within the framework of the invention it has been found that a relatively small value of RSH (smaller than or equal to 0.75) yields relatively straight side faces of the display window, but it has the disadvantage that negative radii of curvature may occur near the comers of the image. Negative radii of curvature adversely affect the local doming and strength of the colour selection electrode. Negative radii of curvature can be precluded, however, this leads to large variations of the radii of curvature along the display window. As a result thereof a reflection image is produced which looks like a distorting mirror and hence, negatively affects picture quality. This effect too, can be precluded to a certain extent, but analysis shows that this leads to an unacceptable increase of the raster distortion. Constructions in which RSH=0.70 or less have straight side faces of the display window, but they exhibit a substantial variation of the radius of curvature along the surface, causing much distortion of reflected images. In addition, local doming near the end of the long axis is substantial, and such constructions exhibit a large degree of raster distortion.

Relatively high values of RSH, for example above or equal to 0.95, generally exhibit a visually relatively small variation of the radii of curvature along the surface. Such high values have the disadvantage, however, that in such a construction the side faces of the display window are fairly curved. A further disadvantage of a construction having a high RSH and relatively considerably curved side faces is that this leads to a high degree of local doming and to an increase of the pincushion-shaped distortion of the image for values of x in the range from 0 to approximately 0.7 $x_{max}$.

Preferably, RSH ranges between 0.80 and 0.90. As RSH decreases from 0.80 to 0.75, the side faces of the display window become ever more straight, but the variation of the radii of curvature along the surface increases. For RSH<0.75, this variation is so large that the reflection image at the display window looks like a distorting mirror. For values higher than 0.80, this effect is no longer disturbing. A reduction of RSH from 0.80 to 0.75 also leads to a reduction of the glass and colour selection electrode strength along the long and/or short axis. As RSH increases from 0.90 to 0.95, the side faces of the display window become ever more curved. Due to this, there is less space for the reduction of local doming.

The construction can be further improved if $R_x$, the radius of curvature in the x-direction, decreases along the long axis in the direction from the centre to the edge (this leads to an increase of the curvature of the surface). Preferably, $R_x(0,0)/R_x(x_{max},0)$ ranges between 1.5 and 4.0. $R_x$ is too small at the end of the long axis for values above 4.0, which lead to visually excessive distortion of the reflection. An increase of local doming occurs at values of $R_x(0,0)/R_x(x_{max},0)$ below 1.5. Preferably, $R_x(0,0)/R_x(x_{max},0)$ ranges between 2.0 and 3.2.

Figure 3:
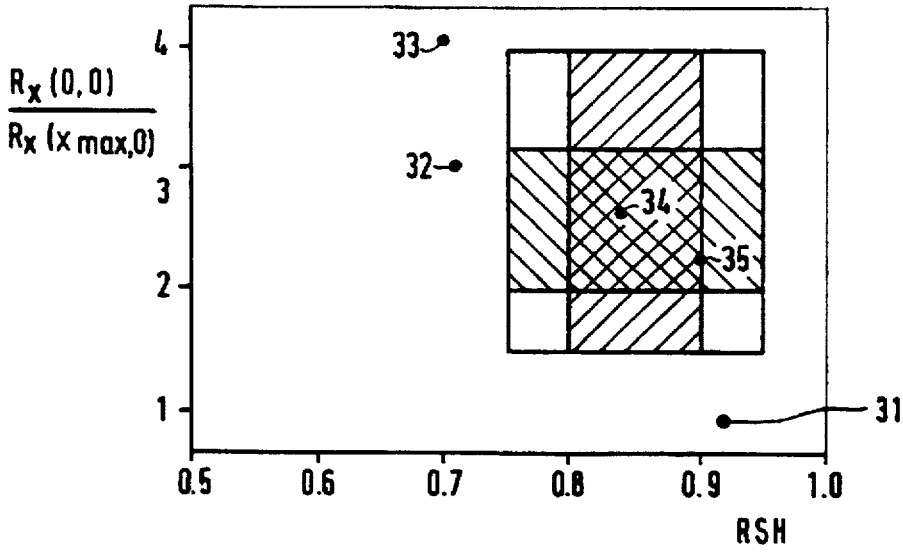
FIG. 3 graphically shows the conditions according to the invention.

FIG. 3 graphically shows RSH on the horizontal axis and $R_x(0,0)/R_x(x_{max},0)$ along the vertical axis. The area as claimed in claim 1 is indicated. Areas in accordance with preferred embodiments (claims 2 and 3) are indicated by a cross-hatched area. In addition, the RSH and $R_x(0,0)/R_x(x_{max},0)$ values are indicated for five constructions. The first construction, indicated by point 31, has a RSH value of 0.92 and a $R_x(0,0)/R_x(x_{max},0)$-value of 1. The second construction, indicated by point 32, has a RSH-value of 0.71 and a $R_x(0,0)/R_x(x_{max},0)$-value of 3.03. The third construction, indicated by point 33, has a RSH-value of 0.70 and a $R_x(0,0)/R_x(x_{max},0)$-value of 4.11. The fourth construction, indicated by point 34, has a RSH-value of 0.837 and a $R_x(0,0)/R_x(x_{max},0)$-value of 2.64. The fifty construction, indicated by point 35, has a RSH-value of 0.900 and a $R_x(0,0)/R_x(x_{max},0)$-value of 2.29. These constructions fall within the hatched area indicated in FIG. 3. The constructions 1–4 relate to a 29" construction having an aspect ratio of 4:3, construction 5 relates to a 29", 16:9 construction. All constructions have average radii of curvature along the diagonal which lie within the range indicated in claim 1.

The most important aspects encountered in the various constructions will be set forth hereinbelow. For this purpose, use will be made of the customary description of screen surfaces, the polynomial expansion in Cartesian coordinates:

$$z=\Sigma(C_{ij}x^iy^j) \quad (2)$$

where i and j are even and positive values and x and y vary from 0 to $x_{max}$ and $y_{max}$, respectively.

We focus our attention mainly on the inside of the screen. The reason for this being that both the writing of the image and raster distortion occur on the inside. In addition, the inside is situated between the outside and the colour selection electrode and the shapes of the outside and the colour selection electrode follow to a considerable degree, yet not completely, the shape on the inside.

The above polynomial expansion in x,y,z can be rewritten in the relative coordinates $X=x/x_{max}$, $Y=y/y_{max}$ and $Z=z/z_{max}$, where $z_{max}$ is the sagittal height in the corner. This gives:

$$z=\Sigma(C_{ij}X^iY^j)$$

where X, Y and Z vary from 0 (centre) to 1, and where $$C_{ij}=c_{ij}x_{max}^i y_{max}^j/z_{max}$$

It holds that $$\Sigma C_{ij}=1.$$

The relative importance of the various terms in the polynomial expansion of Z as a function X and Y is given directly by the $C_{ij}$-coefficients.

In this Cartesian expansion we distinguish between:

X-terms, which depend only on X, comprising the terms with the coefficients $C_{20}$, $C_{40}$ and $C_{60}$, Y-terms, which depend only on Y, comprising the terms with the coefficients $C_{02}$, $C_{04}$ and $C_{06}$, and cross-terms, depending both on X and Y, comprising the terms with the coefficients $C_{22}$, $C_{42}$, $C_{24}$, $C_{44}$, $C_{62}$, $C_{26}$, $C_{64}$, $C_{46}$ and $C_{66}$.

A summary of the values of the $C_{ij}$ coefficients for the insides of the constructions 1–5 is given in Table 1. This Table also gives the values of $z_{max}$(in mm), $z(X_{max},0)$ (in mm) and indicated by $z(X_m,0)$, $z(0,Y_{max})$ (in mm and indicated by $z(0,Y_m)$, RSH and $R_x(0,0)/R_x(X_{max},0)$ (indicated by $R_x/R_{x'}$).

TABLE 1

| construction | 1 | 2 | 3 | 4 | 5 |
|---|---|---|---|---|---|
| $Z_{max}$ | 28.42 | 28.06 | 28.43 | 28.20 | 28.20 |
| $z(X_m,0)$ | 18.89 | 21.62 | 21.76 | 20.96 | 21.33 |
| $z(0,Y_m)$ | 12.14 | 18.08 | 18.78 | 12.73 | 10.00 |
| RSH | 0.92 | 0.71 | 0.70 | 0.837 | 0.90 |
| $R_x/R_{x'}$ | 1 | 3.03 | 4.11 | 2.64 | 2.29 |
| $C_{20}$ | 0.665 | 0.563 | 0.612 | 0.6020 | 0.6925 |
| $C_{40}$ | 0 | 0.208 | 0.023 | 0.1160 | 0 |
| $C_{60}$ | 0 | 0 | 0.130 | 0.0253 | 0.064 |
| $C_{02}$ | 0.427 | 0.503 | 0.578 | 0.4496 | 0.3426 |
| $C_{04}$ | 0 | 0.142 | 0.04 | 0.0018 | 0.0120 |
| $C_{06}$ | 0 | 0 | 0.043 | 0 | 0 |
| $C_{22}$ | −0.092 | −0.21 | −0.333 | −0.0780 | 0 |
| $C_{42}$ | 0 | −0.148 | −0.023 | −0.1440 | −0.1061 |
| $C_{24}$ | −0.0015 | −0.082 | 0.013 | 0.0106 | 0 |
| $C_{44}$ | 0.0021 | −0.017 | −0.123 | 0.0086 | −0.017 |
| $C_{26}$ | 0 | 0 | 0.017 | 0 | 0 |
| $C_{46}$ | 0 | 0 | 0.001 | 0.0082 | 0.012 |
| $C_{66}$ | 0 | 0.042 | 0.022 | 0 | 0 |
| $R_y/R_{y'}$ | 1 | 2.5 | 2.5 | 1 | 1.1 |

Figure 4A:
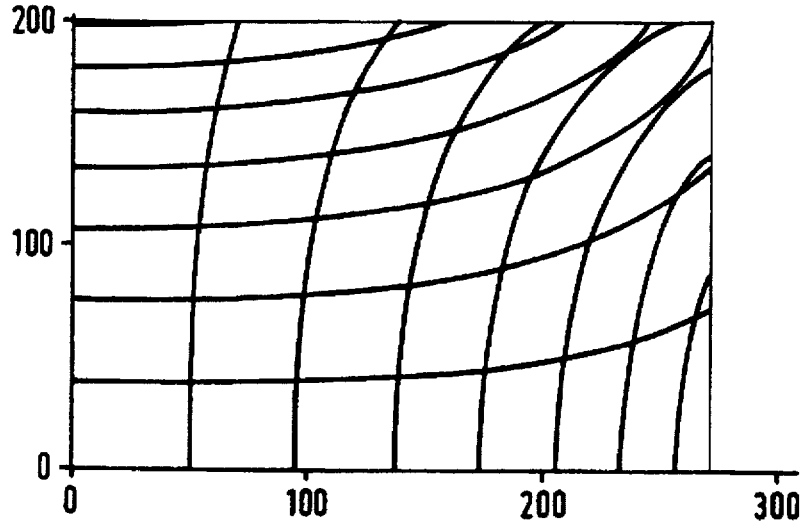
FIGS. 4*a* through 4*c* show graphically a few reflection images at a display window.
Figure 4B:
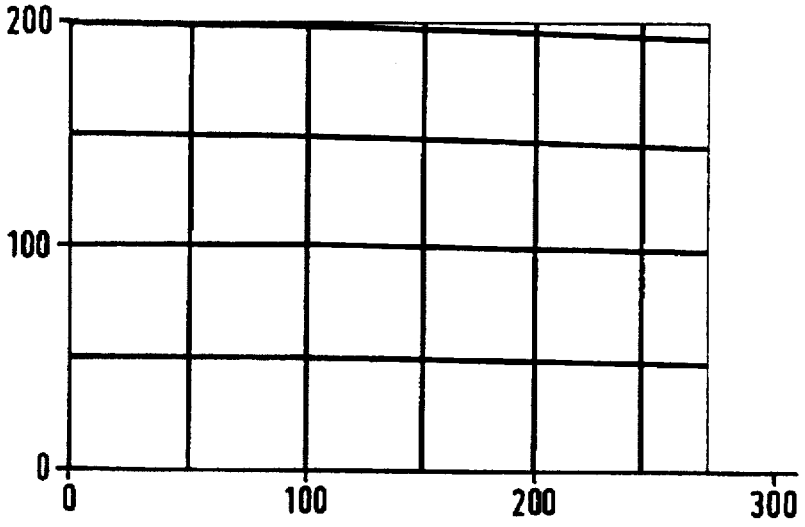
Figure 4C:
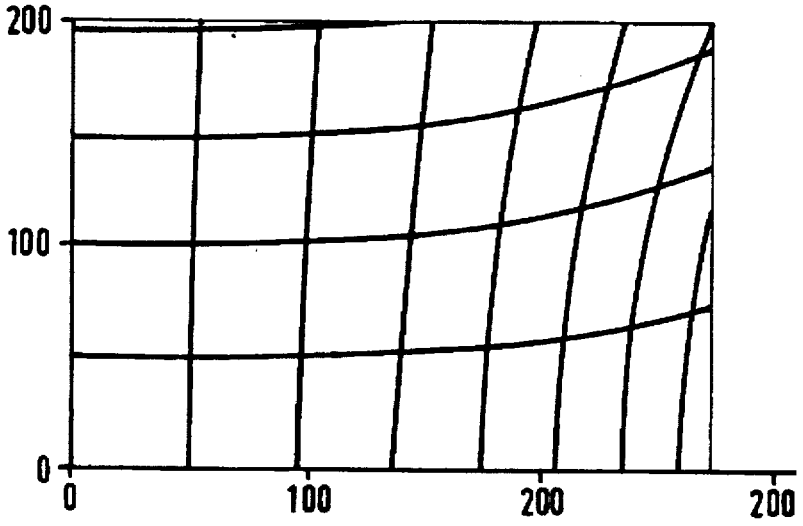

FIGS. 4a up to and including 4c show the reflection image of a raster of right-angled lines at the display screen for constructions 2 and 3 (FIG. 4a), construction 1 (FIG. 4b) and constructions 4 and 5 (FIG. 4c), respectively. In FIG. 4a, the reflection image of the constructions 2 and 3 is clearly distorted. All drawings show a quadrant of the display window. The x- and y-axes are shown and indicated in mm. A much distorted reflection image gives the impression that the image displayed is also distorted and, hence, reduces picture quality. This effect is caused by a substantial variation of the radii of curvature, notably, in the corners of the display window. The constructions 1, 4 and 5 have a much better reflection image. The reflection image of construction 1 is better than that of constructions 4 and 5. However, the difference is only small, and when the effect of local doming is taken into account, it is found that construction 1 exhibits a much higher degree of local doming than constructions 4 and 5. Also construction 2 exhibits a relatively high degree of local doming.

The variation of the radius of curvature $R_y$ along the short axis, the y-axis, is different for each of the constructions 1–5. The quotient $R_y(0,0)/R_y(0,y_{max})$ is indicated in Table 1 by $R_y/R_{y'}$. Preferably, $R_y(0,0)/R_y(0,y_{max})$ ranges between 0.9 and 1.5, where $R_y(0,0)$ represents the radius of curvature along the short axis in the centre of the display window and $R_y(0,y_{max})$ represents the radius of curvature along the short axis at the end of the short axis.

The sagittal height at the end of the short axis is determined to a considerable degree by the choice of RSH and the variation of $R_x$ along the long axis. Aspects relating to strength and an analysis of the raster distortion have given us an insight into the desired variation of $R_y$ along the short axis. A further improved construction can be obtained if $R_y(0,0)/R_y(0,y_{max})$ ranges between 0.9 and 1.5.

A further insight relates to the relation between local doming and the variation of Z as a function of X along the long axis. Local doming can be reduced by the use of a $C_{40}$ term in addition to the $C_{20}$ term. We have found that sub-optimum results are obtained when only a $C_{40}$ term is used to reduce doming. The reason for this being that, at an equal sagittal height at the end of the long axis $C_{20}+C_{40}$ is constant. This follows from the fact that along the long axis it holds that $Z=C_{20}X^2+C_{40}X^4$ and at the end of the long axis it holds that X=1. Adding or increasing $C_{40}$ involves a reduction of $C_{20}$ and a reduced $C_{20}$ leads to an increase of the raster distortion. We have found that it is more efficient to use a $C_{60}$ term to attain an overall optimum. A value above 0.02 for $C_{60}$ already has a considerable effect. Preferably, $C_{60}$ has a value above 0.03.

We claim:

1. A display device having a cathode ray tube which comprises an evacuated envelope having an at least substantially rectangular display window an inside area of which is provided with a phosphor screen, a colour selection electrode being arranged in front of the display window, the envelope accommodating a means for generating at least one electron beams and the display device comprising means for deflecting the electron beams across the phosphor screen, characterized in that the outside surface of the display window has an average radius of curvature along the diagonal ($R_{diag}$) above 2.83×D and below 5.3×D, where D is the length of the diagonal of the display window, and the inside surface of the display window exhibits a relative sagittal height (RSH) which ranges between 0.75 and 0.95, the relative sagittal height being the quotient of the sagittal height at the end of the diagonal across the inside surface and the sum of the sagittal heights at the end of the long axis and at the end of the short axis, also across the inside surface.

2. A display device as claimed in claim 1, characterized in that the relative sagittal height, RSH, ranges between 0.80 and 0.90.

3. A display device as claimed in claim 1, characterized in that the inside surface complies with the formula $1.5<R_x(0,0)/R_x(x_{max},0)<4$, where $R_x(0,0)$ and $R_x(x_{max},0)$ are the radii of curvature along the long axis in the centre of the display window and at the end of the long axis, respectively.

4. A display device as claimed in claim 1, characterized in that for the inside surface it holds that $R_x(0,0)/R_x(x_{max},0)$ is greater than 2.0 and smaller than 3.2.

5. A display device as claimed in claim 1, characterized in that $R_y(0,0)/R_y(0,y_{max})$ ranges between 0.9 and 1.5 for the inside of the display window, where $R_y(0,0)$ is the radius of curvature along the short axis in the centre of the display window and $R_y(0,y_{max})$ is the radius of curvature along the short axis at the end of the short axis.

6. A display device as claimed in claim 1, characterized in that the relative sagittal height, RSH, of the outside surface deviates less than 0.03 (3%) from the RSH of the inside surface.

7. A display device as claimed in claim 1, characterized in that the aspect ratio of the display window, measured along the inside surface, is greater than 4:3.

8. A display device as claimed in claim 2, characterized in that the inside surface complies with the formula $1.5<R_x(0,0)/R_x(x_{max},0)<4$, where $R_x(0,0)$ and $R_x(x_{max},0)$ are the radii of curvature along the long axis in the centre of the display window and at the end of the long axis, respectively.

9. A display device as claimed in claim 2, characterized in that $R_y(0,0)/R_y(0,y_{max})$ ranges between 0.9 and 1.5 for the inside of the display window, where $R_y(0,0)$ is the radius of curvature along the short axis in the centre of the display window and $R_y(0,y_{max})$ is the radius of curvature along the short axis at the end of the short axis.

10. A display device as claimed in claim 3, characterized in that $R_y(0,0)/R_y(0,y_{max})$ ranges between 0.9 and 1.5 for the inside of the display window, where $R_y(0,0)$ is the radius of curvature along the short axis in the centre of the display window and $R_y(0,y_{max})$ is the radius of curvature along the short axis at the end of the short axis.

11. A display device as claimed in claim 4, characterized in that $R_y(0,0)/R_y(0,y_{max})$ ranges between 0.9 and 1.5 for the inside of the display window, where $R_y(0,0)$ is the radius of curvature along the short axis in the centre of the display window and $R_y(0,y_{max})$ is the radius of curvature along the short axis at the end of the short axis.

12. A display device as claimed in claim 7, characterized in that the aspect ratio of the display window, measured along the inside surface, is 16:9.

* * * * *